US009890543B2

(12) United States Patent
Aquilani

(10) Patent No.: US 9,890,543 B2
(45) Date of Patent: Feb. 13, 2018

(54) SURFACE COATING STRUCTURE ADAPTED TO BE QUICKLY INSTALLED AND REMOVED

(71) Applicant: I DECK S.R.L., Vetralla VT (IT)

(72) Inventor: Enrico Aquilani, Vetralla VT (IT)

(73) Assignee: I DECK S.R.L., Vetralla (IT)

( * ) Notice: Subject to any disclaimer, the term of this patent is extended or adjusted under 35 U.S.C. 154(b) by 0 days.

(21) Appl. No.: 15/307,953

(22) PCT Filed: Apr. 27, 2015

(86) PCT No.: PCT/IB2015/052666
§ 371 (c)(1),
(2) Date: Oct. 31, 2016

(87) PCT Pub. No.: WO2015/170205
PCT Pub. Date: Nov. 12, 2015

(65) Prior Publication Data

US 2017/0051515 A1 Feb. 23, 2017

(30) Foreign Application Priority Data

May 5, 2014 (IT) ..... RM2014A0219

(51) Int. Cl.
*E04F 15/04* (2006.01)
*E04F 15/02* (2006.01)
(Continued)

(52) U.S. Cl.
CPC .... *E04F 15/02044* (2013.01); *E04F 13/0819* (2013.01); *E04F 13/0835* (2013.01);
(Continued)

(58) Field of Classification Search
CPC ..... E04F 15/02044; E04F 13/0819; E04F 13/0835; E04F 13/24; E04F 13/26;
(Continued)

(56) References Cited

U.S. PATENT DOCUMENTS 5,299,402 A * 4/1994 Lee ..... E04F 13/0812 52/384
5,394,667 A 3/1995 Nystrom
(Continued)

FOREIGN PATENT DOCUMENTS

CA 2947656 A1 * 11/2015 ..... E04F 13/0835
DE 4122998 A1 * 1/1992 ..... E04F 13/0826
(Continued)

OTHER PUBLICATIONS

International Search Report, dated Aug. 14, 2015, from corresponding PCT application.

*Primary Examiner* — Beth Stephan
(74) *Attorney, Agent, or Firm* — Young & Thompson

(57) ABSTRACT

A surface coating structure adapted to be quickly installed and removed includes a plurality of parallel sections (1), a multiplicity of connecting members (2) and of slats (3) which engage the connecting members (2). Each connecting member (2) is provided with a pair of mutually opposite central angled hooks (4, 4) and a pair of side angled hooks (5, 5). Each slat has an undercut side groove (10) formed in each longitudinal edge (11) of the slat (3) to engage a central angled hook (4) and a bottom prismatic groove (12) in a part opposite to a part in sight near each longitudinal edge (11) of the slat (3). Each bottom prismatic groove (12) has, with respect to the longitudinal edge (11), a proximal side (14) provided with a series of parallel knurls (17) adapted to retain the side angled hook (5) of the connecting member.

20 Claims, 8 Drawing Sheets

(51) Int. Cl.

| | |
|---|---|
| ***E04F 13/08*** | (2006.01) |
| ***E04F 15/10*** | (2006.01) |
| ***E04F 13/10*** | (2006.01) |
| ***E04F 13/18*** | (2006.01) |

(52) U.S. Cl.
CPC ..... *E04F 13/10* (2013.01); *E04F 13/18* (2013.01); *E04F 15/04* (2013.01); *E04F 15/10* (2013.01); *E04F 2015/02072* (2013.01); *E04F 2015/02094* (2013.01); *E04F 2201/0517* (2013.01)

(58) Field of Classification Search
CPC . E04F 13/10; E04F 13/18; E04F 15/04; E04F 15/10; E04F 2015/02072; E04F 2015/02094; E04F 2201/0517
See application file for complete search history.

(56) References Cited

U.S. PATENT DOCUMENTS 5,642,592 A * 7/1997 Andres ..... E04B 5/026 114/266
6,134,854 A * 10/2000 Stanchfield ..... E04F 11/16 52/403.1
6,164,031 A * 12/2000 Counihan ..... E04F 15/02 52/368
6,286,272 B1 * 9/2001 Sandoz ..... E04F 13/10 404/46
9,441,379 B2 * 9/2016 Stover ..... E04F 15/02044
2014/0260043 A1 * 9/2014 Cottier ..... E04F 13/0826 52/489.2
2015/0368911 A1 * 12/2015 Kuijper ..... E04F 15/02044 52/483.1
2016/0060880 A1 * 3/2016 Stover ..... E04F 15/02044 52/582.2
2016/0273230 A1 * 9/2016 Yang ..... E04F 15/02038
2017/0030086 A1 * 2/2017 Rodriguez Lopez ..... E04F 13/0812

FOREIGN PATENT DOCUMENTS

| | | | | |
|---|---|---|---|---|
| DE | 4215273 | A1 * | 11/1993 | ..... E04F 13/10 |
| EP | 1 990 480 | A2 | 11/2008 | |
| EP | 2 149 651 | A1 | 2/2010 | |
| WO | 2006/011173 | A1 | 2/2006 | |
| WO | 20120159162 | A1 | 11/2012 | |

* cited by examiner

SURFACE COATING STRUCTURE ADAPTED TO BE QUICKLY INSTALLED AND REMOVED

TECHNICAL FIELD

The present invention relates to a surface coating structure adapted to be quickly installed and removed.

BACKGROUND ART

EP 2 149 651 A1 discloses a system for laying wood floors without using screws, nails and glue, but by interlocking or wedging them. According to the system of the cited patent, inserted at regular distances on parallel sections of a base frame are connecting members adapted to permanently connect the parallel sections with slats arranged orthogonally to the parallel sections and forming a coating. Such connecting members are C-shaped in their side towards the parallel sections and have end hooks to allow both the connecting members and the parallel sections to be joined. On their opposite side with respect to the parallel sections the connecting members have a first pair of opposite central hooks, between which a spacer acting as an abutment is interposed, and a second pair of side hooks facing the respective central hooks. All the hooks are angled at their free ends in order to engage slats through grooves thereof on the opposite side to the one in sight. In particular, the slats have side grooves and bottom grooves, both having undercuts forming dovetail portions which the free ends of both the central hooks and the side hooks respectively abut from opposite sides.

A drawback is related to the configuration of the grooves, in particular of the bottom grooves: the free ends of the side hooks point against the dovetail portion so that they are fixed in the undercut. The slats, where necessary, can be disassembled, although with difficulty, but there is the risk of a rupture of the hooks.

A solution to this problem was already given by the Applicant who has manufactured prismatic-shaped bottom grooves, i.e. without undercut. In this way each side hook disengages easily the slat, thanks to the fact that a joint not difficult to release is not formed as there is no undercut. In this solution the connection is provided only by the central hooks, and this leads to a reduced stability of the slats with a consequent risk of their displacement as a result of loads applied on the coating structure.

Therefore, a drawback of the surface coating structure of the prior art is to not allow a proper engagement between slats and connecting members.

It should also be highlighted that the surface coating structures in question are intended to both horizontal surfaces, such as floors that must withstand loads by their nature, and vertical surfaces, such as those of the facade walls. In the prior art the connecting members, which serve to transmit the load from the slats to the base frame, are made identical in both cases.

The Applicant found that the connecting members need to be most strong in the case where they are used for coating horizontal surfaces, and they may be less robust in the case where they are used for coating vertical surfaces.

In particular, in the first case it would be useful that the slats rest firmly on the connecting members; in the second case it is convenient that the connecting members are made in such a way that their assembly with the parallel sections that constitute the base frame of the surface coating structure is easy, such an assembly being obtained by inserting the connecting members in the parallel sections.

Another feature of this type of surface coating structure must also be considered: flanked slats rest with their adjacent edges on the same connecting members. In order to obtain a proper support, ends of consecutive slats must not stay between a connecting member and the other, so as to be cantilevered between a section of the base frame and the other; on the contrary, the ends of consecutive slats must stay on the same connecting member. Since the consecutive slats are inserted at successive times, it occurs that an angled hook of the pair of central hooks provided on the upper part of the connecting members is in locked position, inside the side groove of the slat, in virtue of the occurred engagement between an end of a first slat and the connecting member. The insertion of a contiguous end of a second slat consecutive to the first one, which would cause the deformation downwards of the angled hook of the connecting member on which the end of the first slat rests, is hindered by the occurred engagement of the end of the first slat: the final result is an uncertain engagement between the contiguous ends of the two consecutive slats because a single hook must operate in the engagement with two different slats at successive times.

SUMMARY OF THE INVENTION

The present invention aims to overcome the above cited drawbacks.

In particular, an object of the invention is to obtain an easy releasable engagement between connecting members and slats in a surface coating structure so that the same slats can be quickly installed and removed.

Another object of the invention is to provide stronger connecting members for floor coverings and less robust connecting members for wall coverings.

A further object of the invention is to obtain a reliable engagement between the contiguous ends of two consecutive slats on the same connecting member.

These and other objects and advantages are achieved by a surface coating structure adapted to be quickly installed and removed as defined in the main claim and in the dependent claims attached to the present description.

BRIEF DESCRIPTION OF DRAWINGS

Embodiments of the invention are shown in the detailed description which follows, with reference to the accompanying drawings in which.

DESCRIPTION OF EMBODIMENTS OF THE INVENTION

Figure 1:
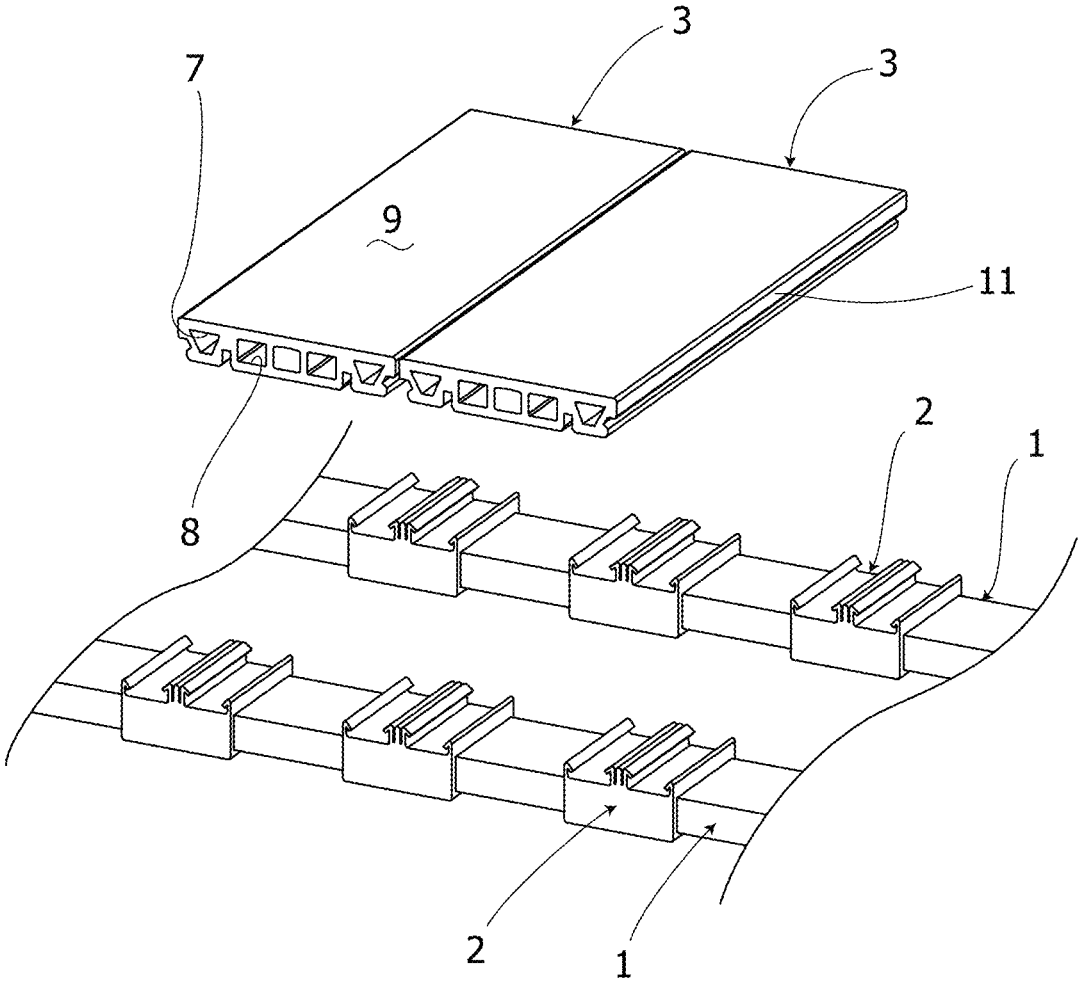
FIG. 1 is a partial, partially exploded perspective view of the surface coating structure according to a first embodiment of the present invention, the slats being cross-sectioned.
Figure 2:
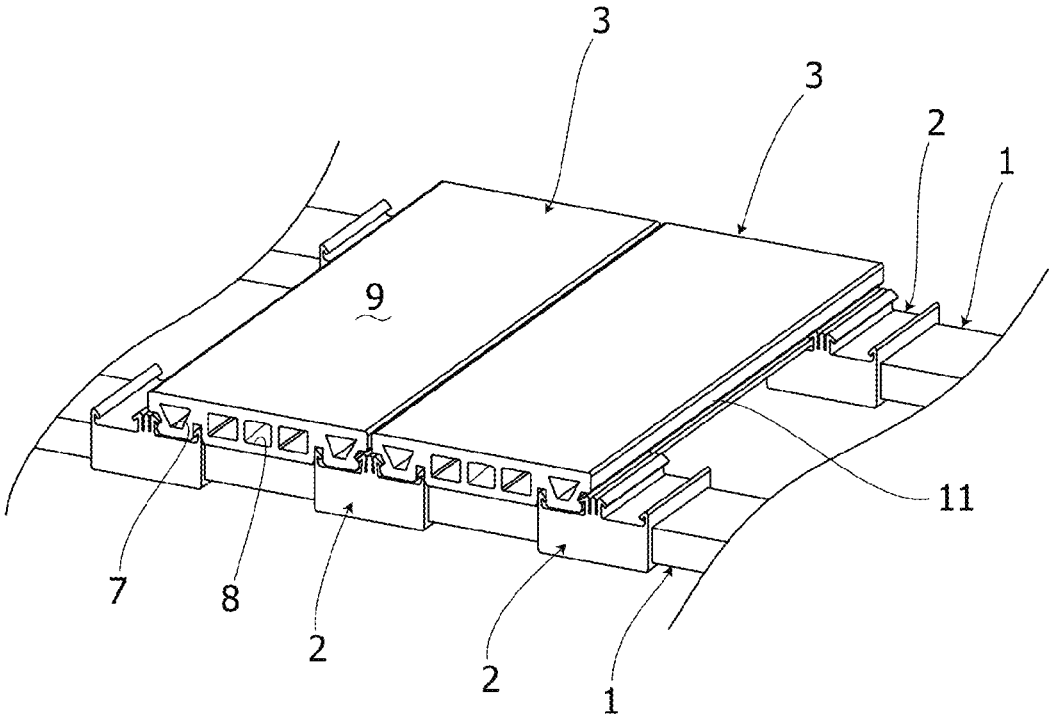
FIG. 2 is a partial perspective view of the surface coating structure shown in FIG. 1 after its assembly.
Figure 3:
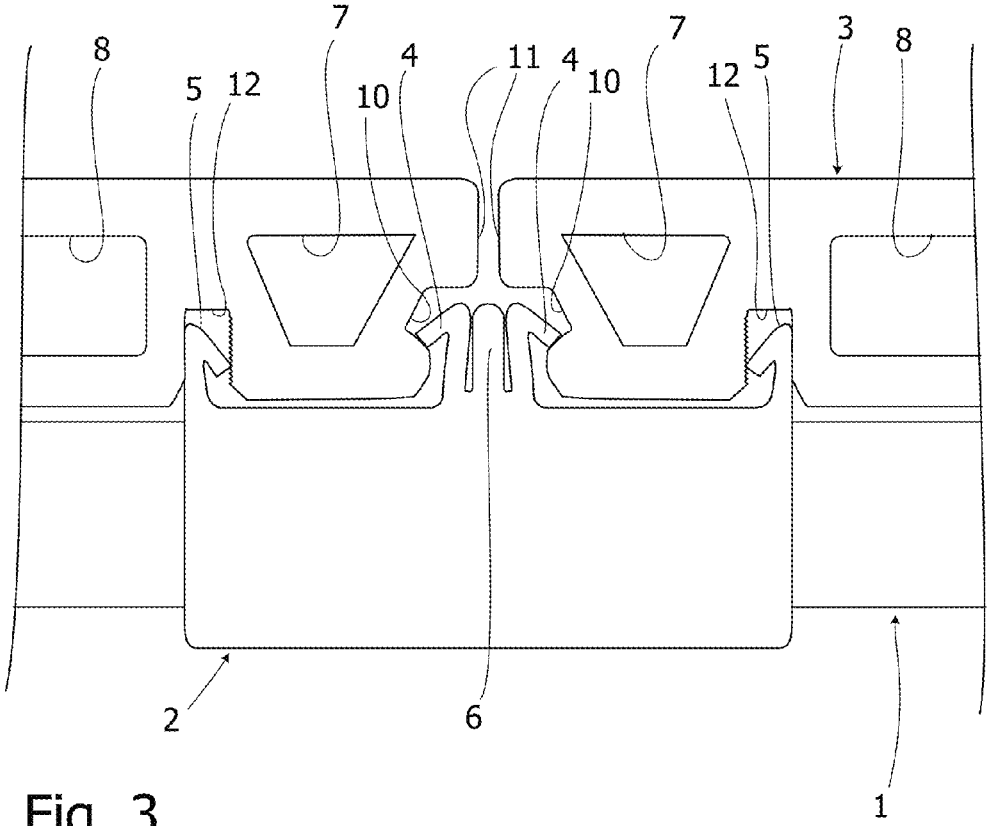
FIG. 3 is an enlarged end view of the surface coating structure in FIG. 2.

Referring to FIGS. 1 and 2 which are partial perspective views of a first embodiment of surface coating structure adapted to be quickly installed and removed according to the present invention, it can be noted that the first embodiment has conventionally a plurality of parallel sections 1 forming a base frame, a multiplicity of connecting members 2 and a multiplicity of slats 3. The parallel sections 1, the connecting members 2 and the slats 3 are only partially shown, as if they were cross-sectioned; it should be understood that they extend according to the needs of the case in order to coat both horizontal surfaces such as floors, and vertical surfaces as walls. The parallel sections 1, in the form of slats, are generally positioned on the surfaces to be coated, and the connecting members 2, differently from what is described in the European patent mentioned above, are sleeve inserted on the sections 1 at regular distances from each other. As known, the connecting members 2, which are made of plastic material, have a first part that surrounds the section 1 and is adapted to restrain it, and a second part that is opposite to the first part and faces the slats 3. This second part, best seen in an enlarged detail in FIG. 3, is provided with a pair of mutually opposite central angled hooks, generically indicated as 4, 4 and a pair of side angled hooks, generically indicated as 5, 5. Each side angled hook 5 faces a central angled hook 4, and a spacer 6 acting as an abutment is interposed between the central angled hooks 4, 4.

Figure 4:
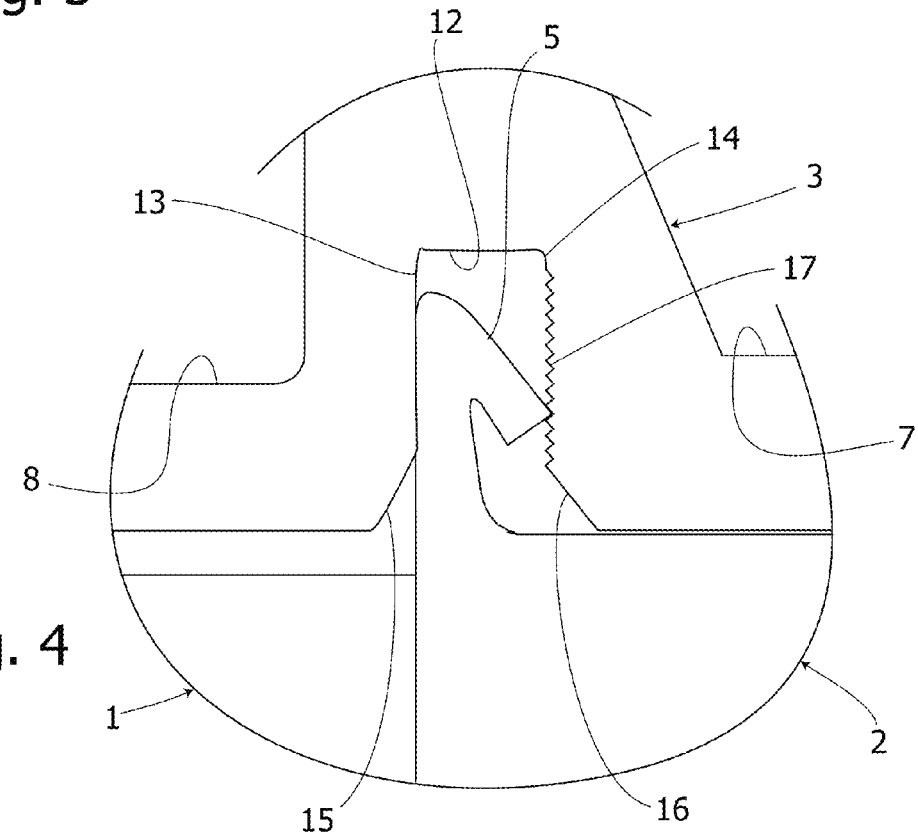
FIG. 4 is a further enlarged detail in FIG. 3.

The slats 3, which may be solid or provided with holes such as those generally indicated as 7 and 8, have a part in sight indicated as 9 in FIGS. 1 and 2, and an opposite part (not denoted with a reference numeral), which is directed toward the parallel sections 1 forming the base frame of the surface coating structure. Formed on the part opposite to the part in sight 9 is a side groove 10 with undercut in each longitudinal edge 11 of the slat, as shown in FIG. 2. It is known that a central angled hook 4 is intended to engage the side groove 10, as shown in detail in FIG. 3. In the same part opposite to the part in sight 9 of each slat is a bottom prismatic groove 12 in proximity of the longitudinal edge 11 of the slat, as best shown by a further enlarged detail in FIG. 4. Each bottom prismatic groove 12 has a distal side 13 and a proximal side 14, with respect to the near longitudinal edge 11. The distal side 13 and the proximal side 14 are parallel to each other except in an inlet part of the bottom prismatic groove 12 where there are facing beveled edges 15 and 16. The facing beveled edges 15 and 16 are useful to facilitate the entry of the side angled hook 5 in the bottom prismatic groove 12, and to ensure the mutual engagement.

According to the invention, each bottom prismatic groove 12 has a series of parallel knurls 17 on its proximal side 14 along the longitudinal extension of the slat 3. The parallel knurls 17 are adapted to retain the side angled hook 5, because the free end of the angled portion of the hook abuts in elastic way against a knurl of the series of parallel knurls 17. In this way, created between each connecting member 2 and each slat 3 is a retention that is stable enough to prevent the slats 3 to be peeled off from the parallel sections 1 of the base frame, but such as to allow mutual detachment by a key in case of removal of the surface coating structure.

Although the slats 3 have been represented with a perforated cross-section, they may also have a solid cross-section, especially if they are of wood. Alternatively, as known, the slats 3 may be made of a composite material comprising vegetable substances and polymeric materials.

Figure 5:
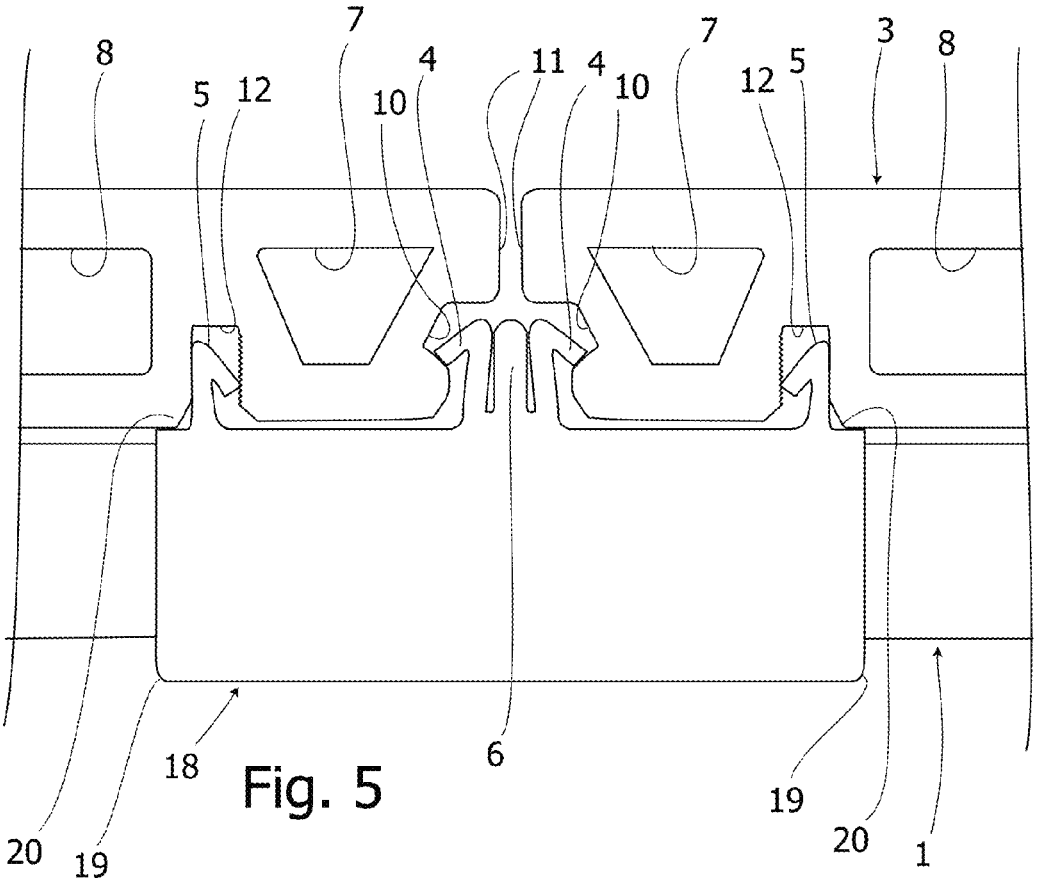
FIG. 5 is a view that shows similarly to FIG. 3 a connecting member according to a second embodiment of surface coating structure of the present invention.

Reference is made now to FIG. 5 which similarly to FIG. 3 is a view showing a connecting member 18 according to a second embodiment of the surface coating structure of the present invention. The other parts of this embodiment, which are similar to those in FIG. 3, are indicated by the same reference numerals.

It can be noted that the connecting member 18 is extended into the ends in direction parallel to the sections 1 of the base frame with portions 19, 19 that allow the support of the slats 3 in the vicinity of the bottom prismatic groove 12 in their portions 20, 20. In this way, the connecting member 18 is more robust with respect to the connecting member 2 of the first embodiment, and this allows it to withstand high stresses which may result from vertical loads when the surface coating structure according to the present invention covers walkable floors.

Figure 6:
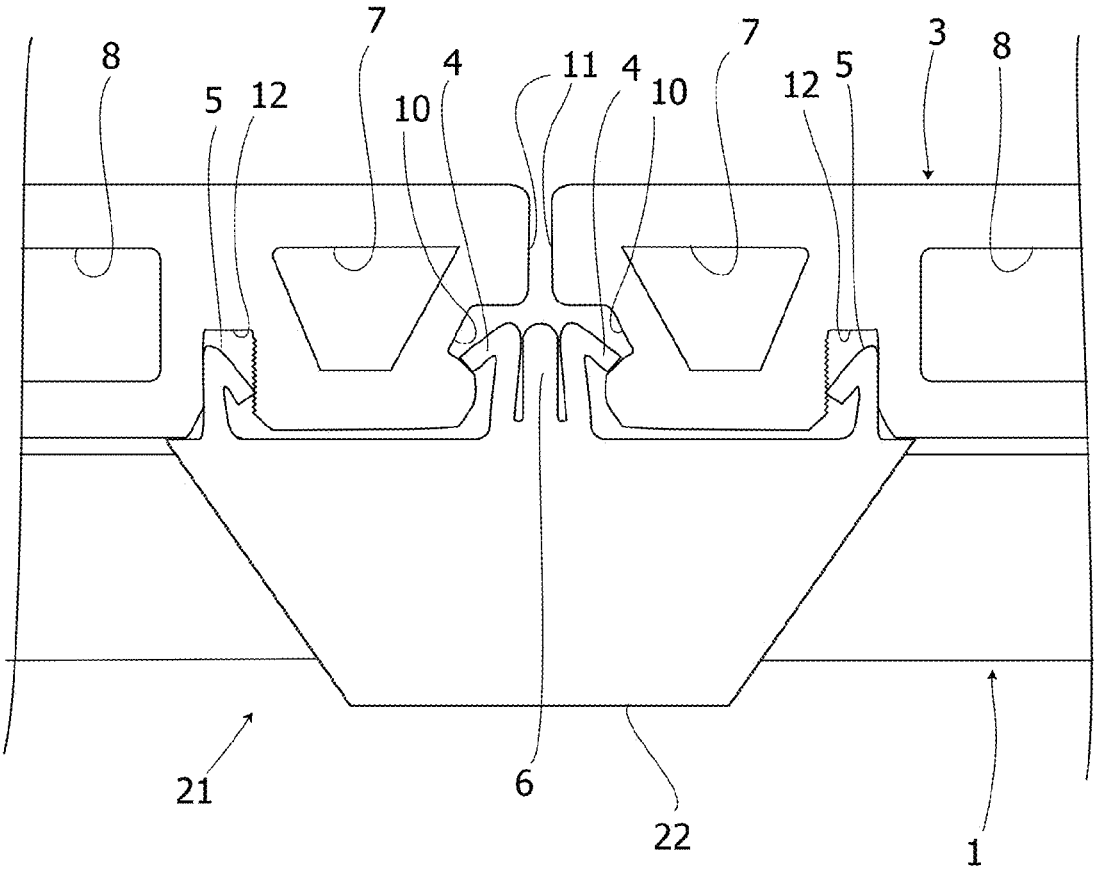
FIG. 6 is a view that shows similarly to FIG. 3 a connecting member according to a third embodiment of surface coating structure of the present invention.

Reference is made now to FIG. 6 which similarly to FIG. 3 is a view showing a connecting member 21 according to a third embodiment of the surface coating structure according to the present invention. The connecting member 21 has a trapezium-shaped side profile, since it is relieved at its opposite ends. The support base 22 of the connecting member 21 is, therefore, smaller than that of the connecting members 2 and 18 of the previous embodiments. The connecting member 21 is therefore considered not suitable for a surface coating structure destined to a floor but could be particularly advantageous for a surface coating structure of walls where loads are not applied on it. Advantages derive from the lower consumption of material for manufacturing the connecting member 21, but also from the increased convenience of insertion of the same member in the base frame sections, thanks to the lower contact surface between the connecting member 21 and the section 1 on which the connecting member 21 is sleeve mounted. Ultimately a faster assembly of the surface coating structure is assured.

Figure 7:
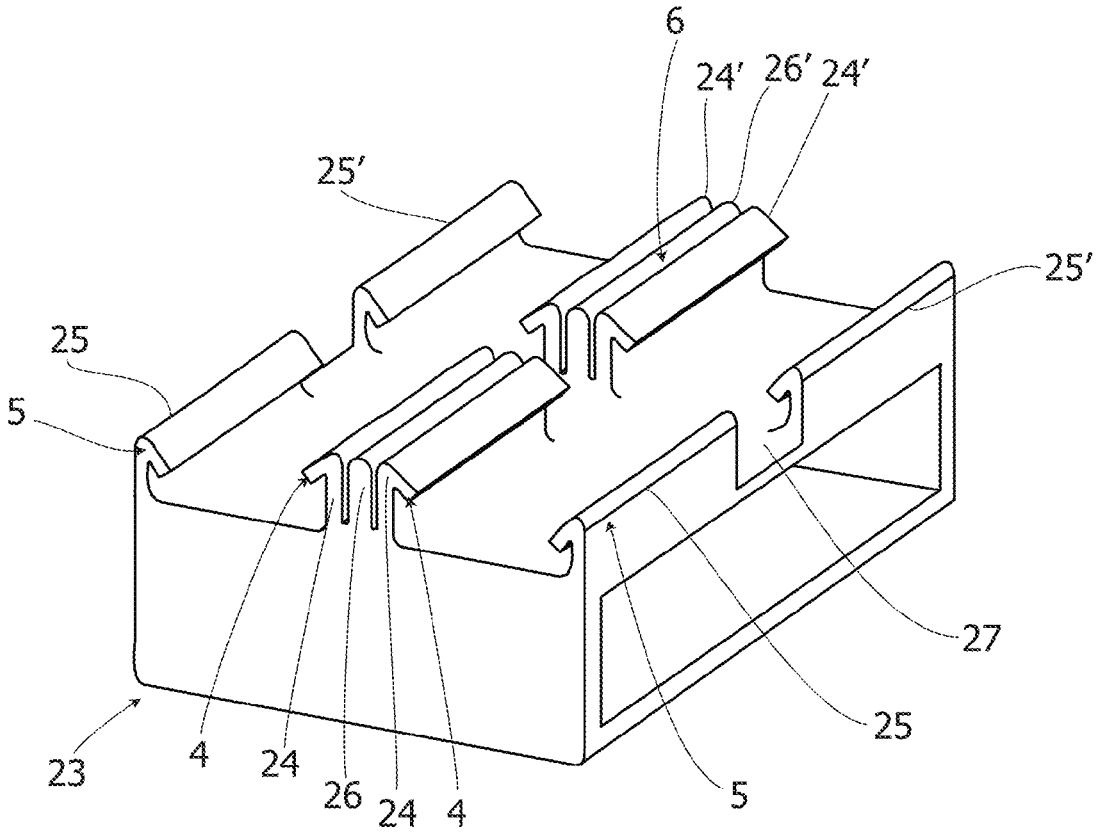
FIG. 7 is a perspective view of a connecting member according to a third embodiment of surface coating structure of the present invention.

Referring to FIG. 7, there is shown a perspective view of a connecting member 23 according to a third embodiment of the surface coating structure of the present invention. The connecting member 23, like the connecting member 2, has a first part that surrounds the section 1 and is adapted to restrain it, and a second part, opposite to the first part, facing the slats 3. This second part differs from that of the connecting member 2 because the pair of mutually opposite central angled hooks 4, 4, the pair of side angle hooks 5, 5, and the spacers 6, 6 are not continuous but are separated by a gap 27 into a pair of front central angled hooks 24, 24 and rear central angled hooks 24', 24', into front side angled hooks 25, 25 and rear side angled hooks 25', 25' and into a front spacer 26 and a rear spacer 26'. The gap 27 can be chosen of the desired size as a function of the accuracy achieved in the manufacture of the components of the surface coating structure and in their installation because in correspondence thereof there are, for a correct support, the ends of consecutive slats so as not to be cantilevered between a base frame section and the other. In fact, since the consecutive slats are inserted at successive times, it happens that the pair of front central angle hooks 24, 24 is in locked position, inside the side recess 10 of a first slat 3, for the occurred engagement between one end of the same and the connecting member 23. The insertion of the next contiguous end of a second slat 3, consecutive to the first one, acts on a rear central angled hook 24', but not on the front central angled hook 24 which is in a locked position inside the side recess 10 of the first slat 3. Therefore, the deflection downwards of the rear central angled hook 24' of the connecting member 23 is not contrasted by the occurred engagement of the end of the first slat 3 with the front center angled hook 24. Consequently, since the front and rear central angled hooks work separately, the final result is a reliable engagement between the adjacent ends of the two consecutive slats.

Figure 8:
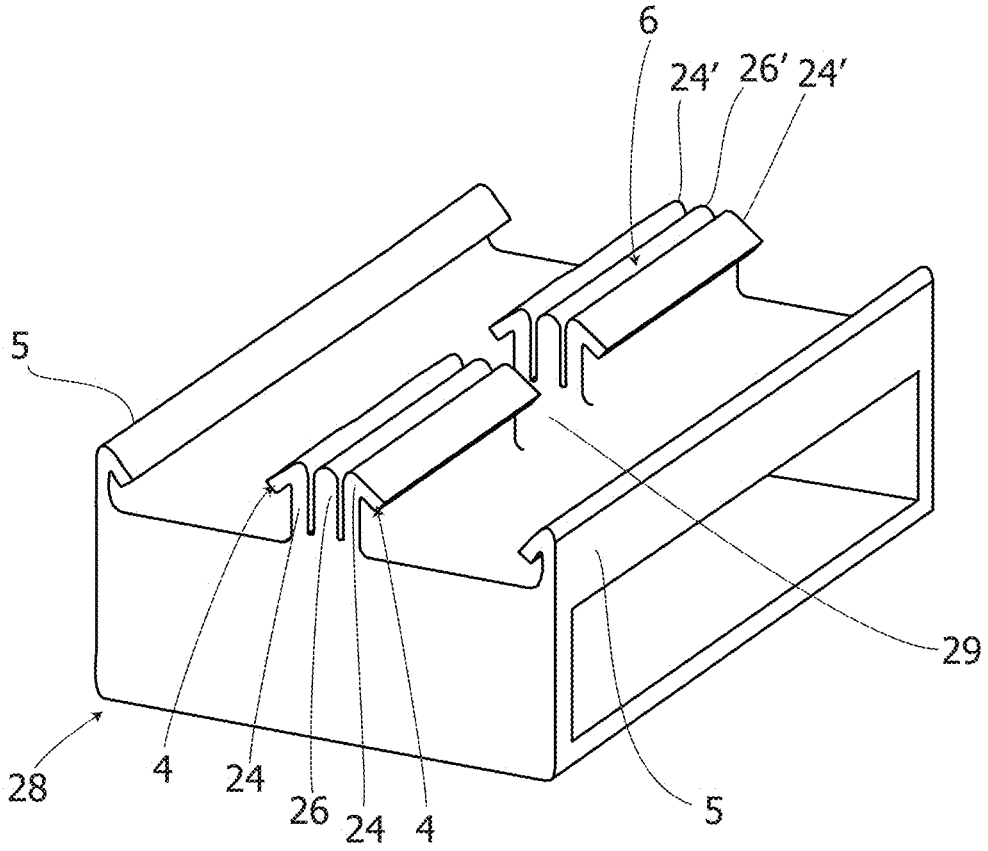
FIG. 8 is a perspective view of a connecting member according to a first modification of the third embodiment of surface coating structure of the present invention.

Referring to FIG. 8, which is a perspective view of a connecting member 28 according to a first variant of the third embodiment of the surface coating structure of the present invention, similar parts thereof are indicated with the same reference numerals. Only the central angled hooks 4, 4 and the spacer 6 are separated by a gap 29 into front central angled hooks 24, 24 and rear central angled hooks 24', 24', and into a front spacer 26 and a rear spacer 26', while the side angled hooks 5, 5 are continuous. It is also clear that this constructive solution of the connecting member could be valid for obtaining a valid support of the ends of the slats 3.

Figure 9:
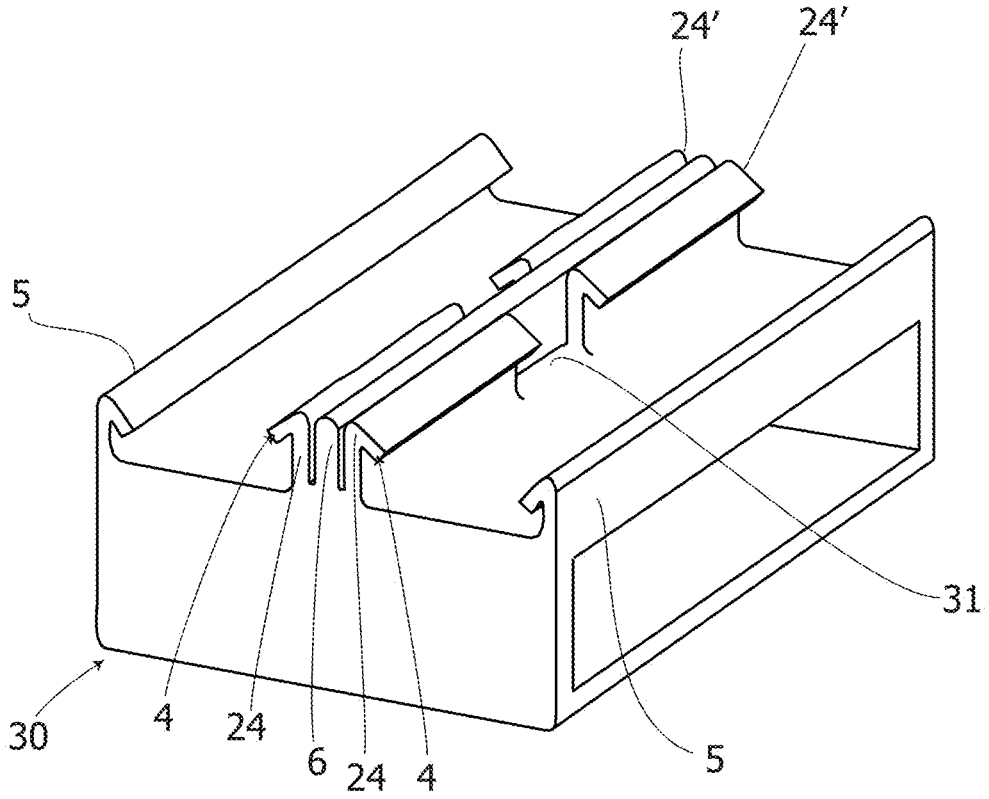
FIG. 9 is a perspective view of a connecting member according to a second modification of the third embodiment of surface coating structure according to the present invention.

Reference is made now to FIG. 9, which is a perspective view of a connecting member 30 according to a second variant of the third embodiment of the surface coating structure of the present invention. In FIG. 9 parts equal to those in FIG. 8 are indicated with the same reference numerals. Only the central angled hooks 4, 4 are separated by a gap 31 into front central angled hooks 24, 24 and rear central angled hooks 24', 24'. It is also clear that this constructive solution of the connecting member could be valid for obtaining a valid support of the ends of the slats 3.

It should be evident that the connecting member 23 according to the third embodiment and its variants 28 and 30 illustrated above can be used not only for the connection of the ends of the slats but also in all the surface coating structure according to the present invention.

These and other features of the invention described above may have other variants that nevertheless fall within the scope of the appended claims.

The invention claimed is:

1. A surface coating structure adapted to be quickly installed and removed comprising:

a plurality of parallel sections (1) forming a base frame;

a multiplicity of connecting members (2; 18; 21; 23; 28; 30), each of said connecting members having a first part facing a section (1) of said plurality of parallel sections (1) and adapted to engage it, and a second part which is opposite to the first part and is provided with a pair of mutually opposite central angled hooks (4, 4) and a pair of side angled hooks (5, 5), each side angled hook (5) respectively facing a central angled hook (4), a respective spacer (6) acting as an abutment being interposed between the central angled hooks (4, 4); and a multiplicity of slats (3) adapted to be arranged orthogonally to the parallel sections (1) to form a coating, each of the slats (3) having longitudinal edges (11), an exposed part (9) and a part opposite to the part in sight (9), an undercut side groove (10) being formed in each longitudinal edge (11) of the slat (3) to engage a central angled hook (4) of the connecting member, and a bottom prismatic groove (12) being formed in the part opposite to the exposed part near each longitudinal edge (11) of the slat (3), each bottom prismatic groove (12) having a distal side (13) and a proximal side (14) both sides being parallel to said longitudinal edge (11) near thereto and engaging a side angled hook (5) of the connecting member, wherein each bottom prismatic groove (12) has on its proximal side (14) a series of parallel knurls (17) adapted to retain said side angled hook (5) of the connecting member, and wherein each central angled hook (4) of each connecting member (30) is separated into a front central angled hook (24) and a rear central angled hook (24') by means of a gap (31).

2. The surface coating structure according to claim 1, wherein said connecting member (21) has a trapezium-shaped side profile with a reduced support base (22).

3. The surface coating structure according to claim 1, wherein said bottom prismatic groove (12) has bevelled edges (15, 16).

4. The surface coating structure according to claim 1, wherein said first part of the connecting member is adapted to surround a section of said plurality of parallel sections (1).

5. The surface coating structure according to claim 1, wherein said slats (3) are wooden and have a solid cross-section.

6. The surface coating structure according to claim 1, wherein said slats (3) are made of a composite comprising vegetable substances and polymeric materials and have a perforated cross-section.

7. A surface coating structure adapted to be quickly installed and removed comprising:

a plurality of parallel sections (1) forming a base frame;

a multiplicity of connecting members (2; 18; 21; 23; 28), each of said connecting members having a first part facing a section (1) of said plurality of parallel sections (1) and adapted to engage it, and a second part which is opposite to the first part and is provided with a pair of mutually opposite central angled hooks (4, 4) and a pair of side angled hooks (5, 5), each side angled hook (5) respectively facing a central angled hook (4), a respective spacer (6) acting as an abutment being interposed between the central angled hooks (4, 4); and a multiplicity of slats (3) adapted to be arranged orthogonally to the parallel sections (1) to form a coating, each of the slats (3) having longitudinal edges (11), an exposed part (9) and a part opposite to the part in sight (9), an undercut side groove (10) being formed in each longitudinal edge (11) of the slat (3) to engage a central angled hook (4) of the connecting member, and a bottom prismatic groove (12) being formed in the part opposite to the exposed part near each longitudinal edge (11) of the slat (3), each bottom prismatic groove (12) having a distal side (13) and a proximal side (14) both sides being parallel to said longitudinal edge (11) near thereto and engaging a side angled hook (5) of the connecting member, wherein each bottom prismatic groove (12) has on its proximal side (14) a series of parallel knurls (17) adapted to retain said side angled hook (5) of the connecting member, and wherein each central angled hook (4) and the spacer (6) of each connecting member (28) are separated into a front central angled hook (24) and a rear central angled hook (24'), and into a front spacer (26) and a rear spacer (26') by means of a gap (29).

8. The surface coating structure according to claim 7, wherein said connecting member (21) has a trapezium-shaped side profile with a reduced support base (22).

9. The surface coating structure according to claim 7, wherein said bottom prismatic groove (12) has bevelled edges (15, 16).

10. The surface coating structure according to claim 7, wherein said first part of the connecting member is adapted to surround a section of said plurality of parallel sections (1).

11. The surface coating structure according to claim 7, wherein said slats (3) are wooden and have a solid cross-section.

12. The surface coating structure according to claim 7, wherein said slats (3) are made of a composite comprising vegetable substances and polymeric materials and have a perforated cross-section.

13. A surface coating structure adapted to be quickly installed and removed comprising:

a plurality of parallel sections (1) forming a base frame;

a multiplicity of connecting members (2; 18; 21; 23; 28), each of said connecting members having a first part facing a section (1) of said plurality of parallel sections (1) and adapted to engage it, and a second part which is opposite to the first part and is provided with a pair of mutually opposite central angled hooks (4, 4) and a pair of side angled hooks (5, 5), each side angled hook (5) respectively facing a central angled hook (4), a respective spacer (6) acting as an abutment being interposed between the central angled hooks (4, 4); and a multiplicity of slats (3) adapted to be arranged orthogonally to the parallel sections (1) to form a coating, each of the slats (3) having longitudinal edges (11), an exposed part (9) and a part opposite to the part in sight (9), an undercut side groove (10) being formed in each longitudinal edge (11) of the slat (3) to engage a central angled hook (4) of the connecting member, and a bottom prismatic groove (12) being formed in the part opposite to the exposed part near each longitudinal edge (11) of the slat (3), each bottom prismatic groove (12) having a distal side (13) and a proximal side (14) both sides being parallel to said longitudinal edge (11) near thereto and engaging a side angled hook (5) of the connecting member, wherein each bottom prismatic groove (12) has on its proximal side (14) a series of parallel knurls (17) adapted to retain said side angled hook (5) of the connecting member, and wherein each central angled hook (4), each side angled hook (5), and the spacer (6) of each connecting member (23) are separated into a front central angled hook (24) and a rear central angled hook (24'), into a front side angled hook (25) and a rear side angled hook (25'), and into a front spacer (26) and a rear spacer (26') by means of a gap (27).

14. The surface coating structure according to claim 13, wherein said connecting member (21) has a trapezium-shaped side profile with a reduced support base (22).

15. The surface coating structure according to claim 13, wherein said bottom prismatic groove (12) has bevelled edges (15, 16).

16. The surface coating structure according to claim 13, wherein said first part of the connecting member is adapted to surround a section of said plurality of parallel sections (1).

17. The surface coating structure according to claim 13, wherein said slats (3) are wooden and have a solid cross-section.

18. The surface coating structure according to claim 13, wherein said slats (3) are made of a composite comprising vegetable substances and polymeric materials and have a perforated cross-section.

19. A surface coating structure adapted to be quickly installed and removed comprising:

a plurality of parallel sections (1) forming a base frame;

a multiplicity of connecting members (2; 18; 21; 23; 28), each of said connecting members having a first part facing a section (1) of said plurality of parallel sections (1) and adapted to engage it, and a second part which is opposite to the first part and is provided with a pair of mutually opposite central angled hooks (4, 4) and a pair of side angled hooks (5, 5), each side angled hook (5) respectively facing a central angled hook (4), a respective spacer (6) acting as an abutment being interposed between the central angled hooks (4, 4); and a multiplicity of slats (3) adapted to be arranged orthogonally to the parallel sections (1) to form a coating, each of the slats (3) having longitudinal edges (11), an exposed part (9) and a part opposite to the part in sight (9), an undercut side groove (10) being formed in each longitudinal edge (11) of the slat (3) to engage a central angled hook (4) of the connecting member, and a bottom prismatic groove (12) being formed in the part opposite to the exposed part near each longitudinal edge (11) of the slat (3), each bottom prismatic groove (12) having a distal side (13) and a proximal side (14) both sides being parallel to said longitudinal edge (11) near thereto and engaging a side angled hook (5) of the connecting member, wherein each bottom prismatic groove (12) has on its proximal side (14) a series of parallel knurls (17) adapted to retain said side angled hook (5) of the connecting member, and wherein each connecting member (18) includes opposite end portions (19, 19) between the side angled hooks and the first part of each connecting member that support portions (20, 20) of the flanked slats (3, 3).

20. The surface coating structure according to claim 19, wherein said opposite end portions (19, 19) of the connecting member (18) supports the portions (20, 20) of flanked slats (3, 3) in a vicinity of the bottom prismatic groove (12) at each of the pair of side angled hooks (5, 5).

* * * * *